US008995893B2

(12) United States Patent
Koda et al.

(10) Patent No.: US 8,995,893 B2
(45) Date of Patent: Mar. 31, 2015

(54) FIXING DEVICE AND IMAGE FORMING APPARATUS

(71) Applicant: KYOCERA Document Solutions Inc., Osaka-shi, Osaka (JP)

(72) Inventors: Syoji Koda, Osaka (JP); Masaru Takagi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 13/950,551

(22) Filed: Jul. 25, 2013

(65) Prior Publication Data

US 2014/0029989 A1 Jan. 30, 2014

(30) Foreign Application Priority Data

Jul. 30, 2012 (JP) ..... 2012-167977

(51) Int. Cl.
*G03G 15/20* (2006.01)

(52) U.S. Cl.
CPC ..... *G03G 15/2085* (2013.01); *G03G 15/2032* (2013.01); *G03G 2215/0132* (2013.01)
USPC ..... 399/323

(58) Field of Classification Search
CPC ..... G03G 15/2085
USPC ..... 399/323
See application file for complete search history.

(56) References Cited

U.S. PATENT DOCUMENTS

2010/0221047 A1* 9/2010 Nakajima et al. ..... 399/323
2010/0303521 A1* 12/2010 Ogawa et al. ..... 399/323

FOREIGN PATENT DOCUMENTS

JP 2006-195039 7/2006

* cited by examiner

*Primary Examiner* — David Gray
*Assistant Examiner* — Thomas Giampaolo, II
(74) *Attorney, Agent, or Firm* — Gerald E. Hespos; Michael J. Porco; Matthew T. Hespos

(57) ABSTRACT

A fixing device includes a supporting mechanism and contact members. The supporting mechanism pivotably supports a separating member. The contact members come into contact with the circumferential surface near both ends of the first roller and form a gap having a predetermined distance between the distal end of the tabular member and the circumferential surface of the first roller. The supporting mechanism includes first and second fulcrum members functioning as a fulcrum for pivoting of the separating member and first and second holes provided in the separating member. The first fulcrum member is inserted into the first hole and the second fulcrum member is inserted into the second hole. The first hole is a hole that allows the separating member to substantially shift only in a predetermined direction. The second hole is a hole that does not substantially restrict displacement of the separating member.

12 Claims, 15 Drawing Sheets

FIXING DEVICE AND IMAGE FORMING APPARATUS

This application is based upon and claims the priority from Japanese Patent Application No. 2012-167977 filed in Japan Patent Office on Jul. 30, 2012, the entire contents of which are incorporated herein by reference.

BACKGROUND

The present disclosure relates to a fixing device that fixes toner images on a sheet and an image forming apparatus applied with the fixing device.

The fixing device of the image forming apparatus includes a fixing nip portion formed by a fixing roller and a pressurizing roller being brought into press-contact with each other. When the sheet passes through the fixing nip portion, the sheet is pressurized and heated, whereby the toner images on the sheet are fixed on the sheet. Since the sheet is heated when passing through the fixing nip portion, the sheet sometimes adheres to the circumferential surface of the fixing roller. In this case, the sheet winds around the fixing roller after passing through the fixing nip portion.

In order to prevent such winding, a separating member for separating the sheet, which starts to wind around the fixing roller, from the fixing roller is arranged in a position close to the fixing roller on a rotating direction downstream side of the fixing roller. The separating member includes a tabular member extending in the axial direction of the fixing roller. When the distal end of the tabular member and the fixing roller circumferential surface are always in contact with each other, there is a concern that the fixing roller circumferential surface is damaged. When the toner on the sheet is fixed in a state in which the fixing roller circumferential surface is damaged, traces of damage sometimes remain on the toner images. Therefore, a gap having a predetermined distance is formed between the distal end of the tabular member and the fixing roller circumferential surface. The gap is formed by extending the distal end of the tabular member along the circumferential surface of the fixing roller to set the distal end of the tabular member and the axial direction of the fixing roller in parallel to each other.

If the distance of the gap is too small, paper powder sometimes accumulates in the gap portion. On the other hand, if the distance of the gap is too large, sheet separating performance is deteriorated. Therefore, the distance of the gap needs to be set to an appropriate distance that is neither too large nor too small.

However, depending on a twist of the tabular member or a result of alignment of a positional relation between the tabular member and the fixing roller, the distal end of the tabular member cannot be held in parallel to the axial direction of the fixing roller. In this case, the distance between the distal end of the tabular member and the fixing roller circumferential surface cannot be kept uniform.

SUMMARY

A fixing device according to an aspect of the present disclosure includes first and second rollers configured to form a fixing nip portion, a separating member for a sheet, a supporting mechanism, and contact members. The separating member is arranged further on a rotating direction downstream side of the first roller than the fixing nip portion and includes a tabular member extending in the axial direction of the first roller. The supporting mechanism pivotably supports the separating member to change a posture between a first posture in which the distal end of the tabular member comes close to the circumferential surface of the first roller and a second posture in which the distal end separates from the circumferential surface of the first roller. The contact members are attached to the separating member at both end positions of the tabular member respectively. In the first posture, the contact members come into contact with the circumferential surface near both ends of the first roller and form a gap having a predetermined distance between the distal end of the tabular member and the circumferential surface of the first roller. The supporting mechanism includes first and second fulcrum members respectively arranged to be opposed to the both end positions of the tabular member and functioning as a fulcrum for pivoting of the separating member and first and second holes provided in the separating member, the first fulcrum member being inserted into the first hole and the second fulcrum member being inserted into the second hole. The first hole is a hole that allows the separating member to substantially shift only in a predetermined direction. The second hole is a hole that does not substantially restrict displacement of the separating member.

An image forming apparatus according to another aspect of the present disclosure includes an image forming section configured to transfer a toner image onto a sheet and a fixing device configured to fix the toner image on the sheet. The fixing device includes the configuration explained above.

DETAILED DESCRIPTION

Figure 1:
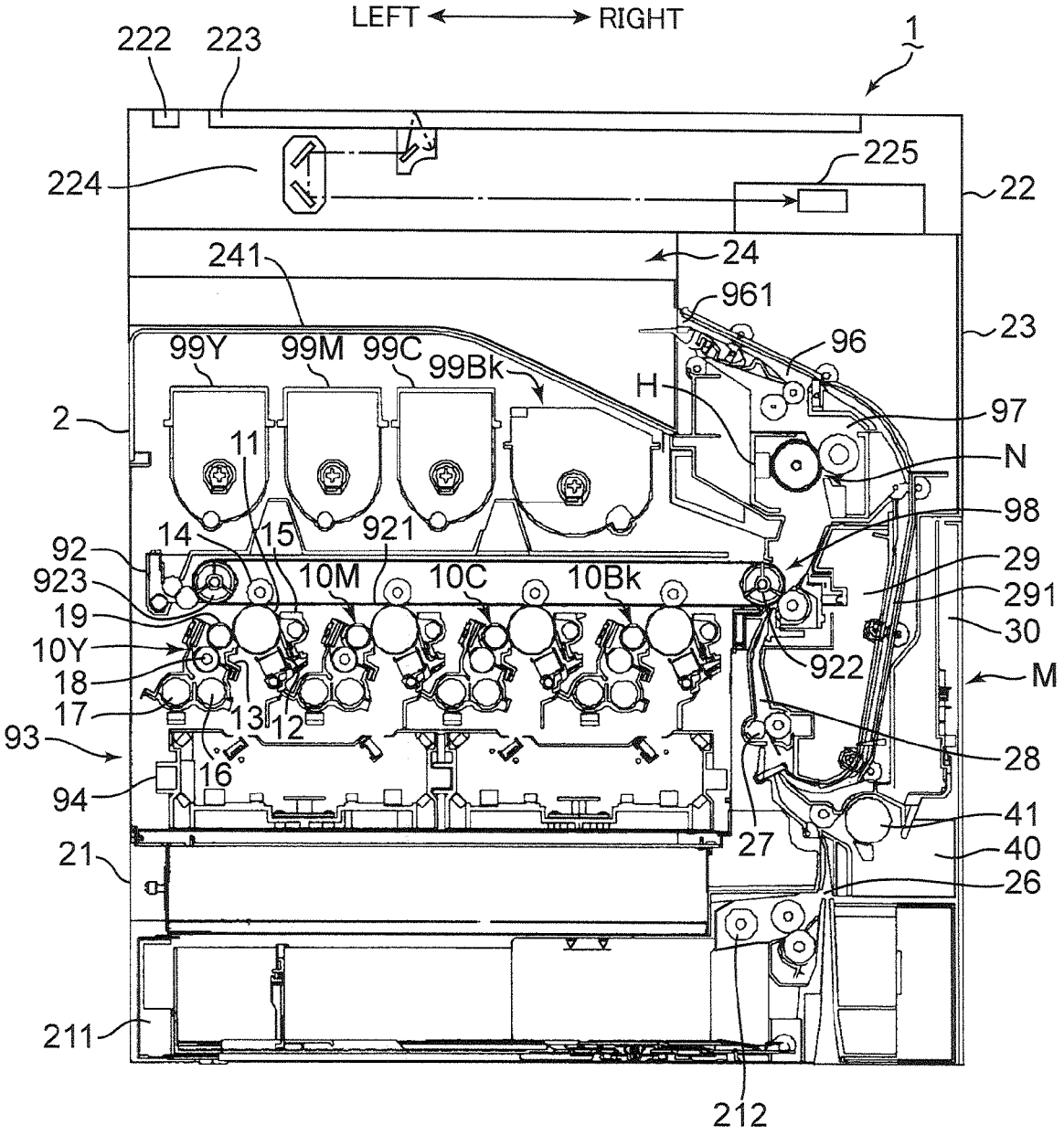
FIG. 1 is a schematic sectional view showing an overall configuration of an image forming apparatus according to an embodiment of the present disclosure.

An embodiment of the present disclosure is explained in detail below on the basis of the drawings. FIG. 1 is a schematic sectional view showing an overall configuration of an image forming apparatus 1 according to the embodiment of the present disclosure. A color copying machine of a tandem type is illustrated as an example of the image forming apparatus. The image forming apparatus may be a monochrome copying machine, a printer, a facsimile apparatus, or a complex machine of these apparatuses.

The image forming apparatus 1 includes an apparatus main body 2 having a substantially rectangular parallelepiped housing structure and including an in-body space. The apparatus main body 2 applies image forming processing to a sheet. The apparatus main body 2 includes a substantially rectangular parallelepiped lower housing 21, a substantially rectangular parallelepiped upper housing 22 disposed above the lower housing 21, and a connecting housing 23 configured to connect the lower housing 21 and the upper housing 22. Various devices for image formation are housed in the lower housing 21. Various devices for optically reading a document image are housed in the upper housing 22. An in-body space surrounded by the lower housing 21, the upper housing 22, and the connecting housing 23 is formed as an in-body paper discharge section 24 in which the sheet after the image formation can be stored. The connecting housing 23 is arranged on the side of a right side surface of the apparatus main body 2. A discharge port 961 for discharging the sheet to the in-body paper discharge section 24 is provided in the connecting housing 23.

The in-body space used as the in-body paper discharge section 24 is opened to the outside on a front surface and a left side surface of the apparatus main body 2. A user can insert his or her hand from opening portions on the front surface and the left side surface and remove the sheet after the image formation from the in-body paper discharge section 24. A bottom surface 241 of the in-body space is defined by an upper surface of the lower housing 21. The sheet discharged from the discharge port 961 is stacked on the bottom surface 241.

A paper feeding cassette 211 configured to store sheets to be subjected to the image forming processing is mounted in the lower housing 21. The paper feeding cassette 211 can be drawn out in a near side direction from the front surface of the lower housing 21 (the apparatus main body 2). The paper feeding cassette 211 is a cassette provided for automatic paper feeding.

On the right side surface of the apparatus main body 2, a multi-tray unit M for causing the user to perform manual paper feeding is mounted. The multi-tray unit M includes a paper feeding tray 30 on which a manually fed sheet is placed and a paper feeding unit 40 configured to transport the manually fed sheet into an image forming section in the lower housing 21. The paper feeding tray 30 is openably/closably attached to the lower housing 21 at a lower end portion of the paper feeding tray 30 and is closed when not in use. When performing the manual paper feeding, the user opens the paper feeding tray 30 and places a sheet on the paper feeding tray 30.

On the inside of the lower housing 21, toner containers 99Y, 99M, 99C, and 99Bk, an intermediate transfer unit 92, an image forming section 93, an exposure unit 94, and the paper feeding cassette 211 are housed in order from above.

In order to form a full-color toner image, the image forming section 93 includes four image forming units 10Y, 10M, 10C, and 10Bk configured to form toner images of yellow (Y), magenta (M), cyan (C), and black (Bk). Each of the image forming units 10Y, 10M, 10C, and 10Bk includes a photosensitive drum 11 and a charger 12, a developing device 13, a primary transfer roller 14, and a cleaning device 15 arranged around the photosensitive drum 11.

The photosensitive drum 11 rotates around the axis thereof. An electrostatic latent image and a toner image are formed on the circumferential surface of the photosensitive drum 11. The charger 12 uniformly charges the circumferential surface of the photosensitive drum 11. The circumferential surface of the photosensitive drum 11 after the charging is exposed to light by the exposure unit 94. An electrostatic latent image is formed on the circumferential surface.

The developing device 13 supplies a toner to the circumferential surface of the photosensitive drum 11 in order to develop the electrostatic latent image formed on the photosensitive drum 11. The developing device 13 is a developing device for a two-component developer. The developing device 13 includes agitating rollers 16 and 17, a magnetic roller 18, and a developing roller 19. The agitating rollers 16 and 17 circulate and carry the two-component developer while agitating the same to charge the toner. A two-component developer layer is born on the circumferential surface of the magnetic roller 18. A toner layer formed by the toner being transferred by a potential difference between the magnetic roller 18 and the developing roller 19 is born on the circumferential surface of the developing roller 19. The toner on the developing roller 19 is supplied to the circumferential surface of the photosensitive drum 11 to develop the electrostatic latent image.

The primary transfer roller 14 forms a nip portion together with the photosensitive drum 11 across an intermediate transfer belt 921 included in the intermediate transfer unit 92 and primarily transfers the toner image on the photosensitive drum 11 onto the intermediate transfer belt 921. The cleaning device 15 cleans the circumferential surface of the photosensitive drum 11 after the toner image transfer.

The toner container for yellow 99Y, the toner container for magenta 99M, the toner container for cyan 99C, and the toner container for black 99Bk are respectively toner containers configured to store toners of the colors. The toner container for yellow 99Y, the toner container for magenta 99M, the toner container for cyan 99C, and the toner container for black 99Bk supply the toners of the colors to the developing devices 13 of the image forming units 10Y, 10M, 10C, and 10Bk respectively corresponding to the colors Y, M, C, and Bk through a not-shown supply route.

The exposure unit 94 configures a part of the image forming section 93. The exposure unit 94 includes various optical devices such as a light source, a polygon mirror, a reflecting mirror, and a deflecting mirror. The exposure unit 94 irradiates light based on image data of a document image and forms an electrostatic latent image on the circumferential surface of the photosensitive drum 11 provided in each of the image forming units 10Y, 10M, 10C, and 10Bk.

The intermediate transfer unit 92 includes an intermediate transfer belt 921, a driving roller 922, and a driven roller 923. Toner images are superimposed one on top of another on the intermediate transfer belt 921 from a plurality of the photosensitive drums 11 (primary transfer). The superimposed toner images are secondarily transferred onto a sheet supplied from the paper feeding cassette 211 or the paper feeding tray 30 in a secondary transfer section 98.

The paper feeding cassette 211 stores a sheet bundle formed by a plurality of sheets being stacked. A pickup roller 212 is arranged in an upper part on the right end side of the paper feeding cassette 211. Sheets in the top layer of the sheet bundle in the paper feeding cassette 211 are let out one by one and carried into a carrying and conveying path 26 by the driving of the pickup roller 212. On the other hand, a sheet placed on the paper feeding tray 30 is carried into the carrying and conveying path 26 by the driving of the paper feeding roller 41 of the paper feeding unit 40.

On the downstream side of the carrying and conveying path 26, a sheet conveying path 28 extending to the discharge port 961 through the secondary transfer section 98, a fixing unit (a fixing device) 97, and a paper discharge unit 96 is provided. An upstream portion of the sheet conveying path 28 is formed between an inner wall formed in the lower housing 21 and an inner wall forming the inner side surface of a reverse conveying unit 29. The outer side surface of the reverse conveying unit 29 forms one surface of a reverse conveying path 291 for reversing and conveying the sheet in duplex printing. A registration roller pair 27 is arranged further on the upstream side than the secondary transfer section 98 in the sheet conveying path 28. The sheet is once stopped by the registration roller pair 27 and, after skew correction is performed, sent to the secondary transfer section 98 at predetermined timing for image transfer.

The fixing unit 97 and the paper discharge unit 96 are housed on the inside of the connecting housing 23. The fixing unit 97 heats and pressurizes, in a fixing nip portion N, a sheet having the toner images secondarily transferred thereon in the secondary transfer section 98 to apply fixing to the sheet. The sheet with a color image subjected to the fixing is discharged from the discharge port 961 toward the in-body paper discharge section 24 by the paper discharge unit 96 arranged downstream of the fixing unit 97.

A first contact glass 222 and a second contact glass 223 are fit in the upper surface of the upper housing 22. The first contact glass 222 is provided for reading of a document sheet automatically fed from an auto document feeder (ADF; not shown in the figure) when ADF is arranged on the upper housing 22. The second contact glass 223 is provided for reading of a document sheet manually placed thereon.

A scanning mechanism 224 and an image pickup element 225 for optically reading document information are housed on the inside of the upper housing 22. The scanning mechanism 224 includes a light source, a moving carriage, and a reflecting mirror and guides reflected light from a document to the image pickup element 225. The image pickup element 225 photoelectrically converts the reflected light into an analog electric signal to thereby acquire image data of the document.

Figure 2:
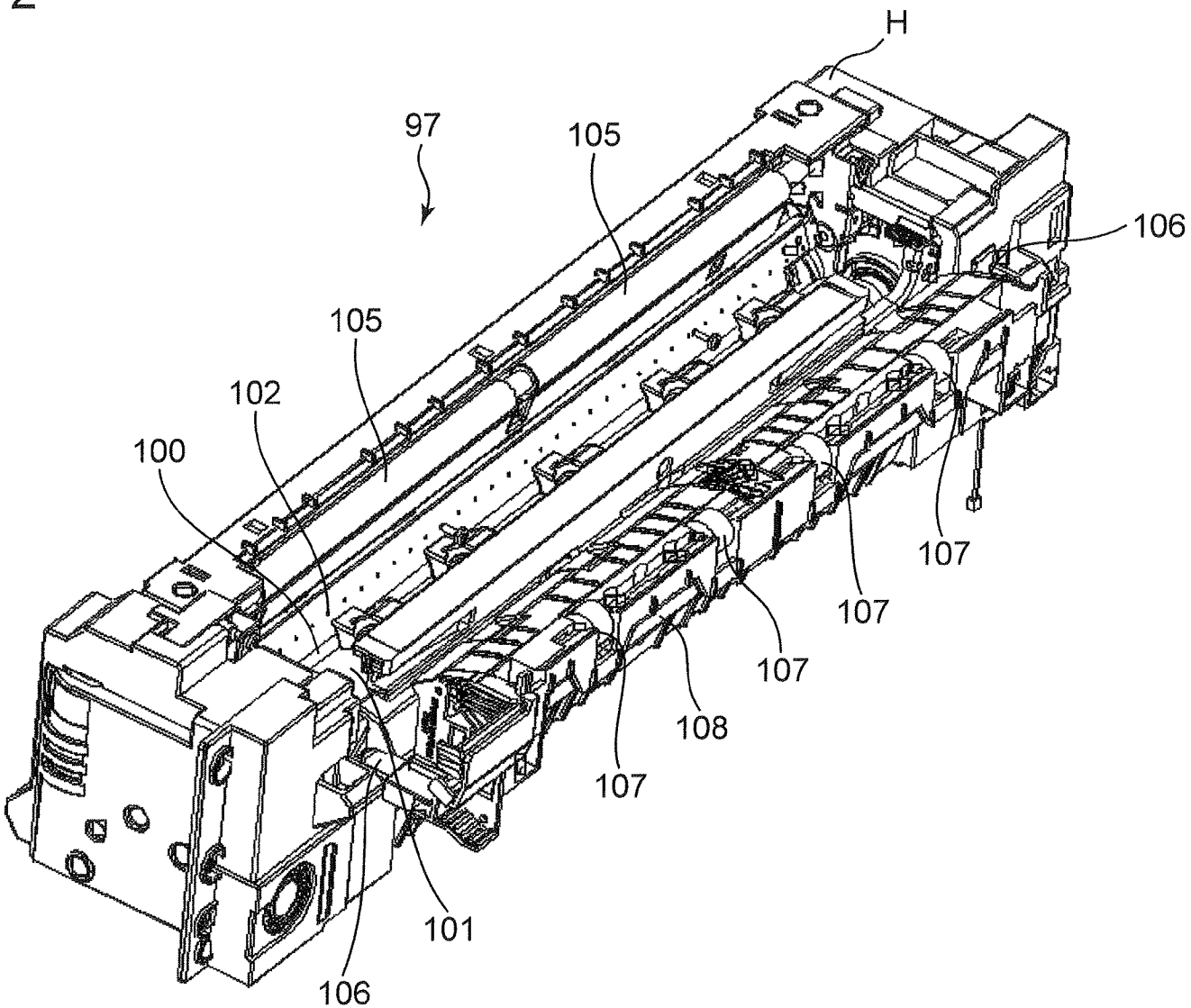
FIG. 2 is a perspective view of a fixing unit incorporated in the image forming apparatus.
Figure 3:
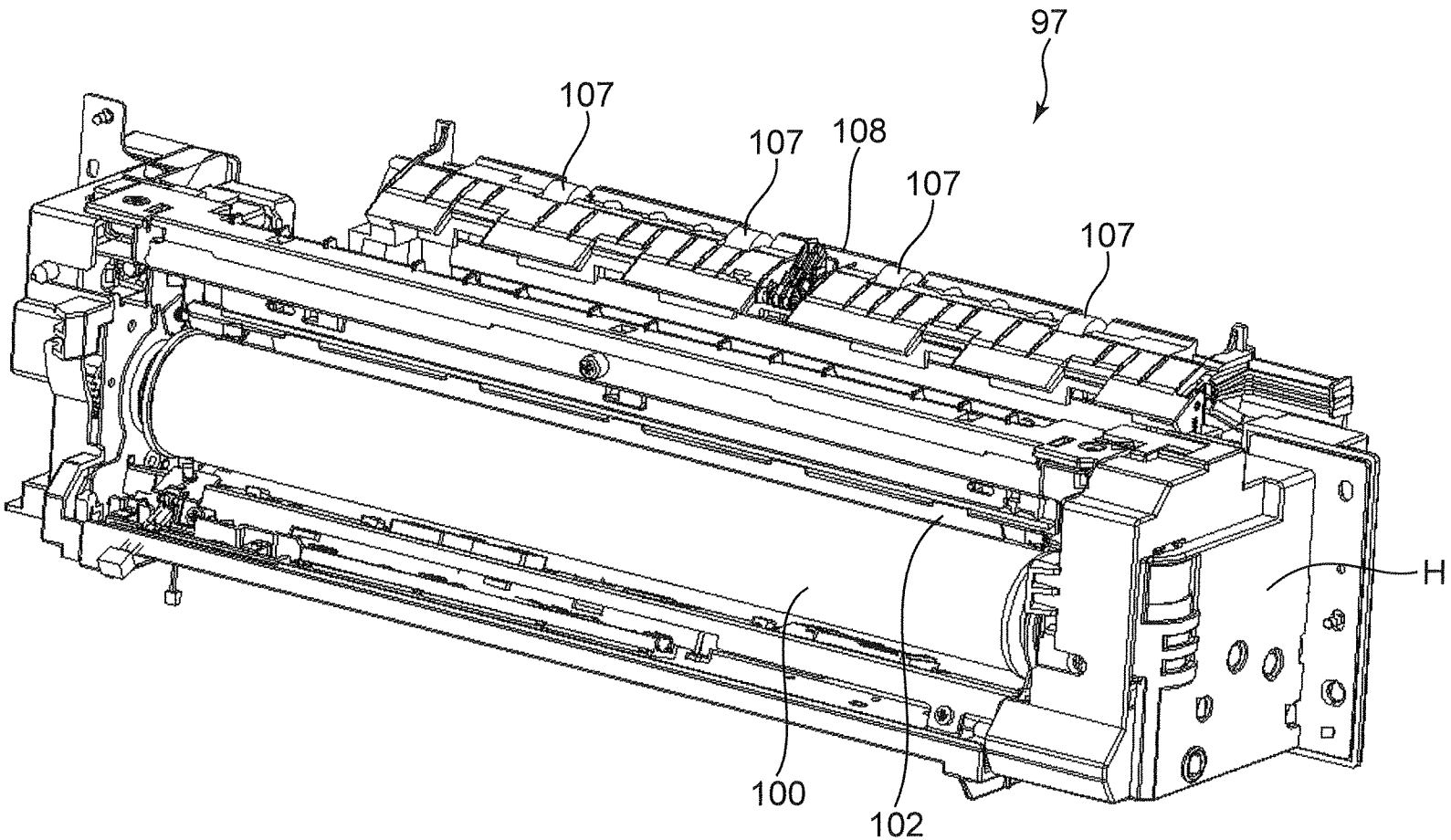
FIG. 3 is a perspective view of the fixing unit viewed from a different line of sight direction.
Figure 4:
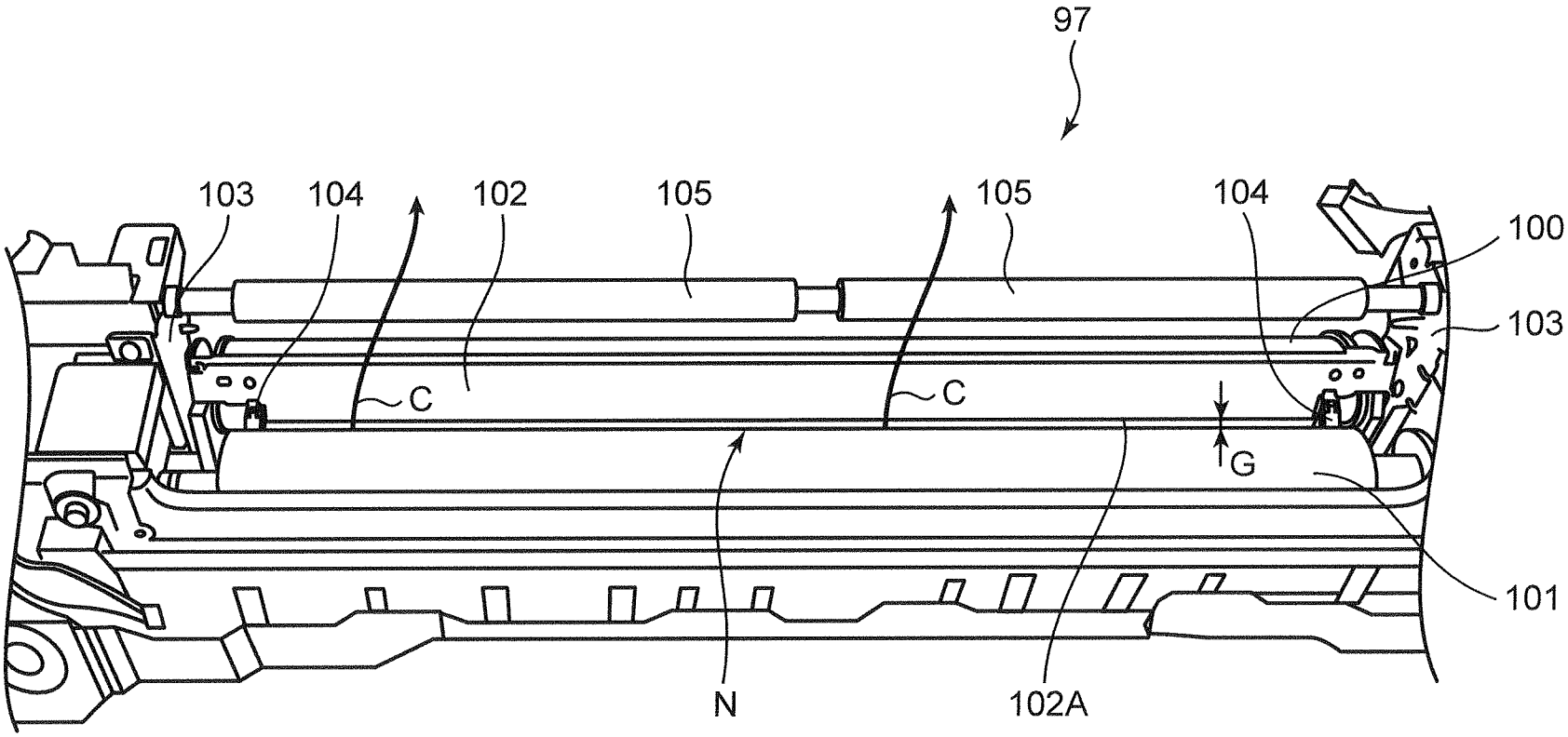
FIG. 4 is a main part perspective view of the fixing unit.

A detailed configuration of the fixing unit 97 is explained below. FIG. 2 is a perspective view of the fixing unit 97. FIG. 3 is a perspective view of the fixing unit 97 viewed from a line of sight direction different from that in FIG. 2. FIG. 4 is a main part perspective view of the fixing unit 97. The fixing unit 97 includes a fixing housing H and a fixing roller 100 (a first roller), a pressurizing roller 101 (a second roller), a separating member 102, supporting members 103, contact members 104, and conveying rollers 105 housed in the fixing housing H.

The fixing housing H is a hosing having a substantially square pole shape long in the front back direction (a direction orthogonal to the paper surface of FIG. 1). Near the top surface of the fixing housing H, the conveying rollers 105 applied with a rotation driving force for conveying a sheet and a cover member 108 configured to cover the top surface are arranged. The cover member 108 pivots around a pivoting fulcrum 106, thereby being capable of opening and closing with respect to the fixing housing H. In FIGS. 2 and 3, the cover member 108 is opened with respect to the fixing housing H. A guide surface for a sheet is formed on the inner wall surface of the cover member 108. A plurality of conveying rollers 107 are arranged on the guide surface. The conveying rollers 107 come into contact with the conveying rollers 105 and form a conveying nip portion when the cover member 108 is closed with respect to the fixing housing H.

Figure 11:
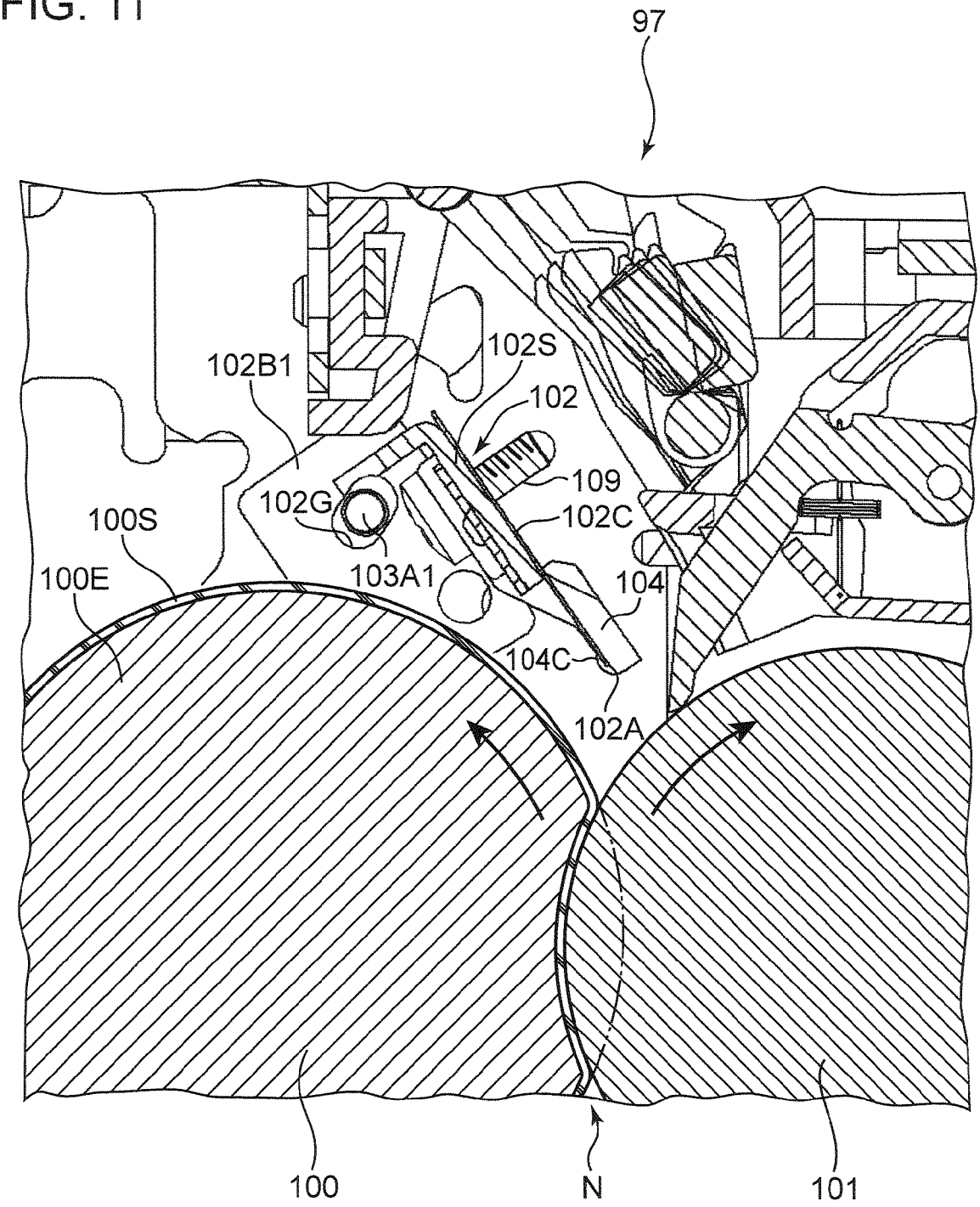
FIG. 11 is a sectional view showing the separating member (on the long hole side) in a second posture.

The fixing roller 100 and the pressurizing roller 101 are rotatably held in the fixing housing H. The rollers are brought into press-contact with each other, whereby the fixing nip portion N is formed. The fixing roller 100 includes, as shown in FIG. 11, a shaft (not shown in the figure) functioning as a rotating shaft, a cylindrical elastic base material 100E provided around the shaft, and a fixing belt 100S overlaid in the outer circumference of the elastic base material 100E. The elastic base material 100E is formed by elastic rubber such as silicon rubber, urethane foam, or the like. The fixing belt 100S is a metal belt such as a stainless steel belt. The pressurizing roller 101 is a roller having rigidity. The pressurizing roller 101 includes a cylindrical metal roller main body and a shaft member extended from both ends of the roller main body.

A sheet having toner images transferred thereon is conveyed in the direction of a thick solid line arrow C in FIG. 4 in the fixing unit 97. In FIG. 4, the cover member 108 is not shown. When passing through the fixing nip portion N, the sheet is heated by the fixing roller 100 and pressurized by the pressurizing roller 101. The toner images are fixed on the sheet by the heating and pressurizing actions.

In the fixing unit 97 configured as explained above, in this embodiment, the separating member 102 is arranged further on a conveying direction downstream side than the fixing nip portion N. The separating member 102 is a member for preventing the sheet passed through the fixing nip portion N from sticking and winding around the circumferential surface of the fixing roller 100. That is, since the sheet is heated when passing through the fixing nip portion N, in some case, the toner images on the sheet melt and stick to the circumferential surface of the fixing roller 100 and the sheet winds around the fixing roller 100. In order to prevent the sheet from winding around the fixing roller 100, the separating member 102 is arranged further on the rotating direction downstream side of the fixing roller 100 than the fixing nip portion N to separate the sheet from the circumferential surface of the fixing roller 100.

The separating member 102 is a substantially rectangular thin tabular member extending in the axial direction of the fixing roller 100. The separating member 102 is supported on the side of the proximal end portion thereof by a pair of supporting members 103 arranged in the vicinities of both ends of the fixing roller 100. The supporting members 103 are fixedly held by the fixing housing H. A gap G having a predetermined distance is secured between a distal end portion 102A of the separating member 102 opposed to the circumferential surface of the fixing roller 100 and the circumferential surface of the fixing roller 100.

When the sheet passed through the fixing nip portion N reaches the gap G while winding around the fixing roller 100, the leading end of the sheet comes into contact with the distal end portion 102A of the separating member 102. Consequently, the sheet is separated from the fixing roller 100. In general, a margin region to which the toner images are not transferred is present at a conveying direction leading end of the sheet. The leading end does not adhere to the fixing roller 100. Therefore, even if the sheet winds around the fixing roller 100, the conveying direction leading end rises from the circumferential surface of the fixing roller 100. Therefore, the separation explained above can be performed even if the distal end portion 102A is not in contact with the circumferential surface of the fixing roller 100.

Figure 5:
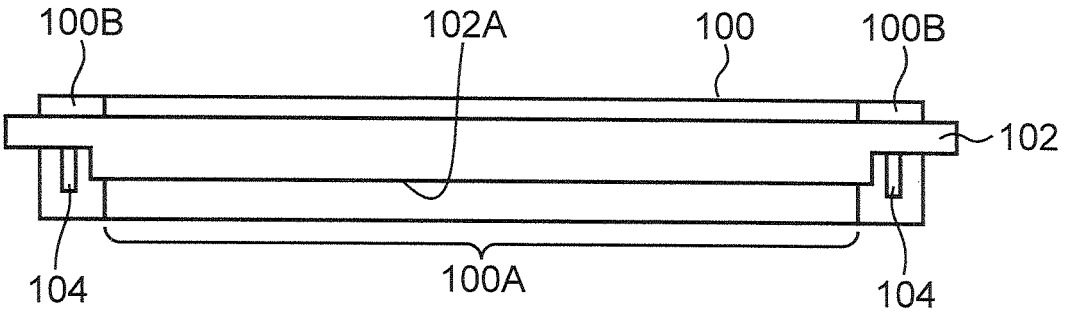
FIG. 5 is a schematic diagram showing a positional relation between contact members and a fixing roller.

A pair of contact members 104 is respectively attached to both ends of the separating member 102 (both end positions of the main body section 102C explained below) to secure the gap G between the distal end portion 102A and the circumferential surface of the fixing roller 100. FIG. 5 is a diagram showing a positional relation between the contact members 104 and the fixing roller 100. The contact members 104 are members arranged to project further forward than the distal end portion 102A of the separating member 102. The contact members 104 come into contact with the circumferential surface of the fixing roller 100 to form the gap G.

A passing region 100A where the sheet passes is set on the circumferential surface of the fixing roller 100. Non-passing regions 100B where the sheet does not pass are set at both ends of the passing region 100A. The contact members 104 come into contact with the non-passing regions 100B, with which the sheet passing through the fixing nip portion N does not come into contact, to thereby form the gap G between the distal end portion 102A and the circumferential surface of the fixing roller 100.

Figure 6A:
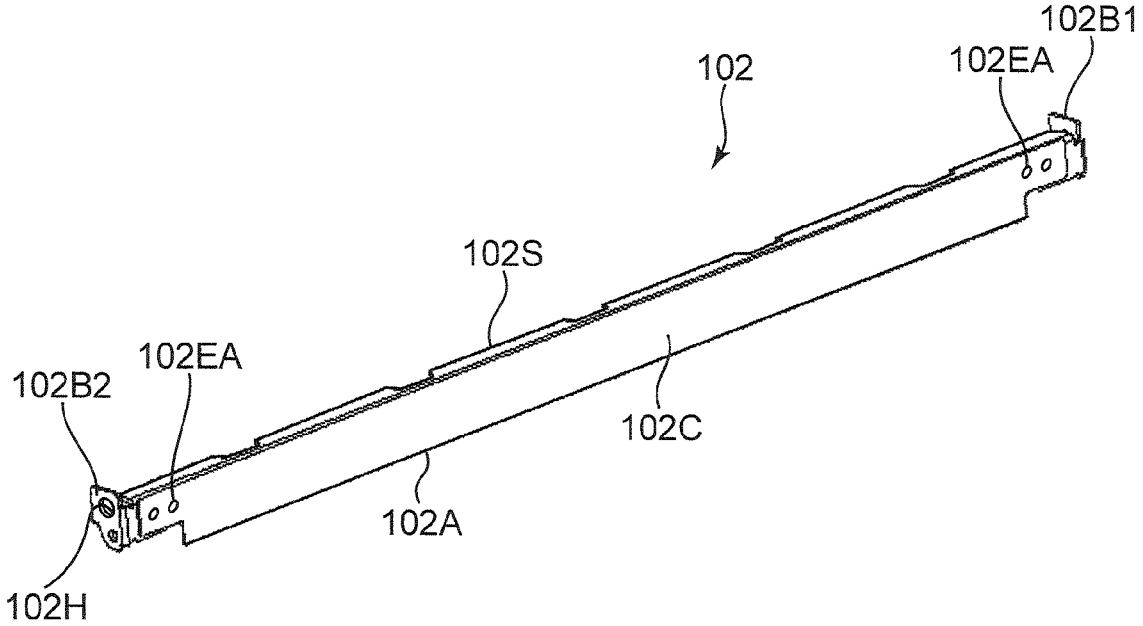
FIG. 6A is a perspective view showing the front surface side of a separating member.
Figure 6B:
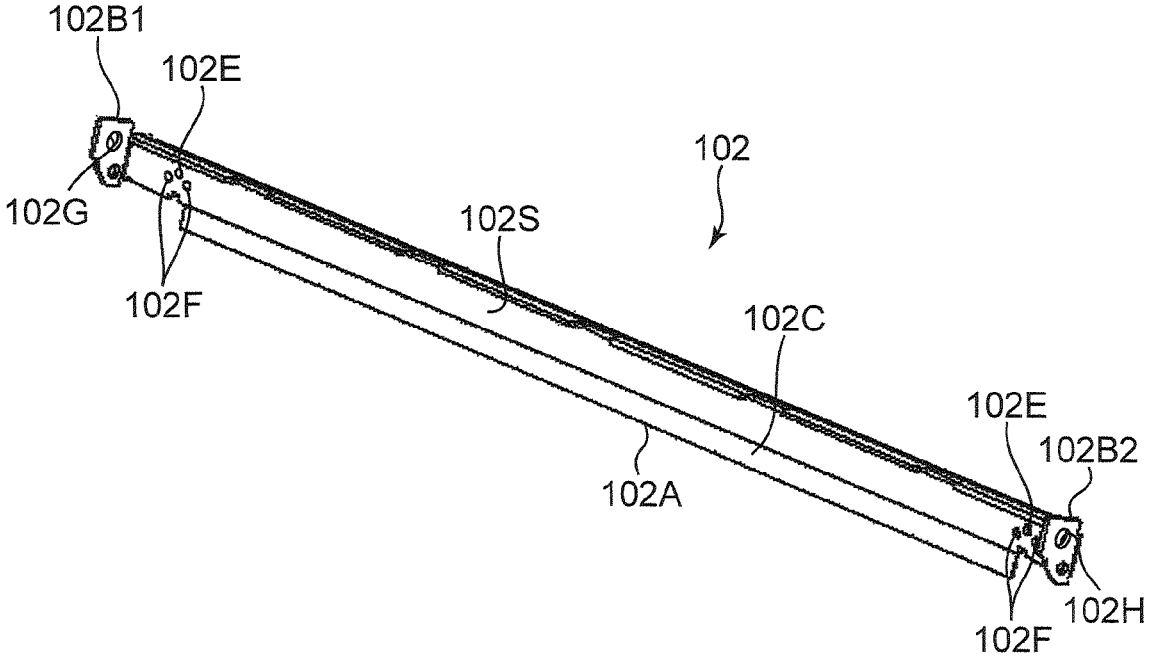
FIG. 6B is a perspective view showing the rear surface side of the separating member.
Figure 7A:
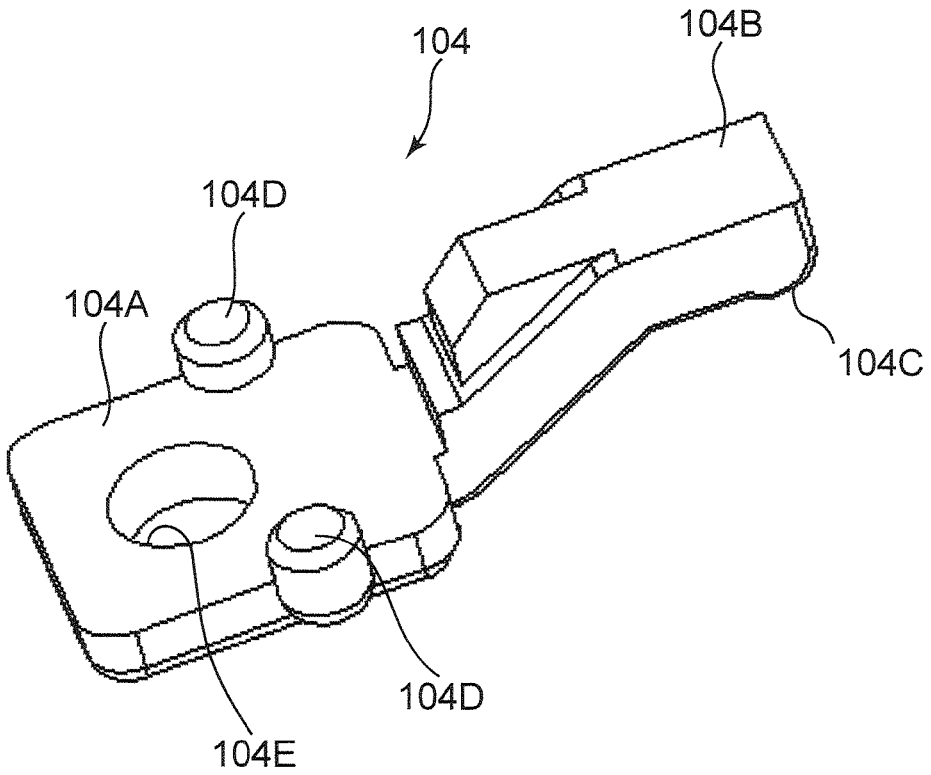
FIG. 7A is a perspective view of the contact member on the side of an attachment surface to the separating member.
Figure 7B:
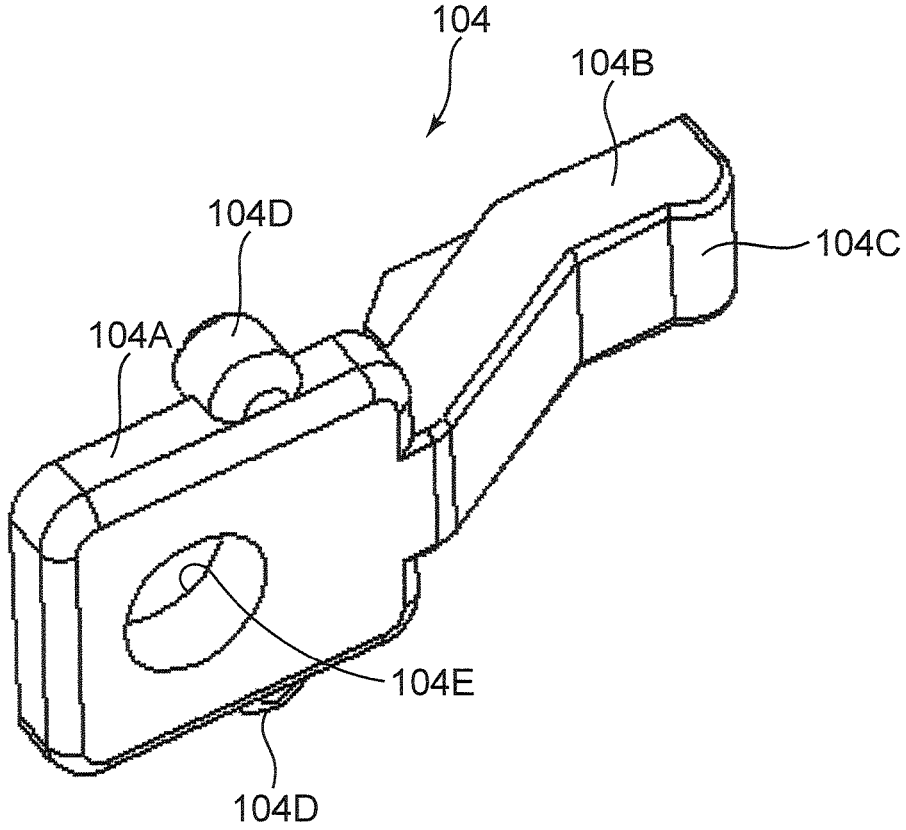
FIG. 7B is a perspective view of the contact member on the side of a contact surface on a fixing belt.

FIG. 6A is a perspective view showing the front surface side of the separating member 102. FIG. 6B is a perspective view showing the rear surface side (a side facing the fixing roller 100) of the separating member 102. FIG. 7A is a perspective view of the contact member 104 on the side of an attachment surface to the separating member 102. FIG. 7B is a perspective view of the contact member 104 on the side of a contact surface on the fixing roller 100.

The separating member 102 includes a thin flat main body section 102C (a tabular member) extending toward the axial direction of the fixing roller 100 and a holding sheet metal 102S (a holding plate) configured to hold the main body section 102C. The lower end edge of the main body section 102C is the distal end portion 102A. The holding sheet metal 102S has a holding flat surface extending toward the axial direction of the fixing roller 100. The main body section 102C is held in close contact with the holding flat surface. The distal end portion 102A projects from the lower end of the holding sheet metal 102S (see FIGS. 11 and 12).

Screw holes 102E and through-holes 102F for attaching the holding sheet metal 102S to the main body section 102C are provided at both ends of the holding sheet metal 102S in order to attach the contact members 104 to the separating member 102 (see FIG. 6B). Screw holes 102EA drilled in positions overlapping the screw holes 102E are provided at both ends of the main body section 102C. On the other hand, holes corresponding to the through-holes 102F are not drilled in the main body section 102C.

As shown in FIGS. 7A and 7B, the contact member 104 includes an attaching section 104A attached to both ends of the holding sheet metal 102S of the separating member 102. In the attaching section 104A, a screw hole 104E for attaching the contact member 104 to the holding sheet metal 102S of the separating member 102 is provided. On a side edge of the attaching section 104A, a pair of positioning pins 104D for positioning and attaching the contact member 104 to the holding sheet metal 102S of the separating member 102 is protrudingly provided across the screw hole 104E.

A main body section 104B having a bent shape is provided continuously to the attaching section 104A. A contact section 104C that comes into contact with the circumferential surface of the fixing roller 100 is protrudingly provided at the distal end of the main body section 104B.

When the contact member 104 is attached to the separating member 102, first, the front side (a side exposed in FIG. 7A) of the attaching section 104A of the contact member 104 is brought into contact with both ends of the rear side (a side exposed in FIG. 6B) of the holding sheet metal 102S of the separating member 102. The positioning pins 104D of the contact member 104 are inserted into the through-holes 102F of the holding sheet metal 102S. The screw hole 104E of the contact member 104 and the screw hole 102E of the holding sheet metal 102S are aligned by the insertion. Thereafter, an attachment screw 109 (see FIGS. 11 and 12) is screwed into the screw hole 104E of the contact member 104 and the screw hole 102E of the separating member 102 from the rear side of the separating member 102. Consequently, the contact member 104 is attached to the separating member 102.

A first end plate 102B1 and a second end plate 102B2 supported by the supporting member 103 are respectively provided at both ends of the holding sheet metal 102S. The end plates 102B1 and 102B2 are portions bent perpendicularly to the holding flat surface of the holding sheet metal 102S. A long hole 102G (a first hole) is provided in the first end plate 102B1. A large-diameter hole 102H (a second hole) is provided in the second end plate 102B2. The long hole 102G and the large-diameter hole 102H are arranged on the proximal end side of the separating member 102 and are drilled in order to axially support the separating member 102 pivotably around an axis parallel to the axial direction of the fixing roller 100.

Figure 8A:
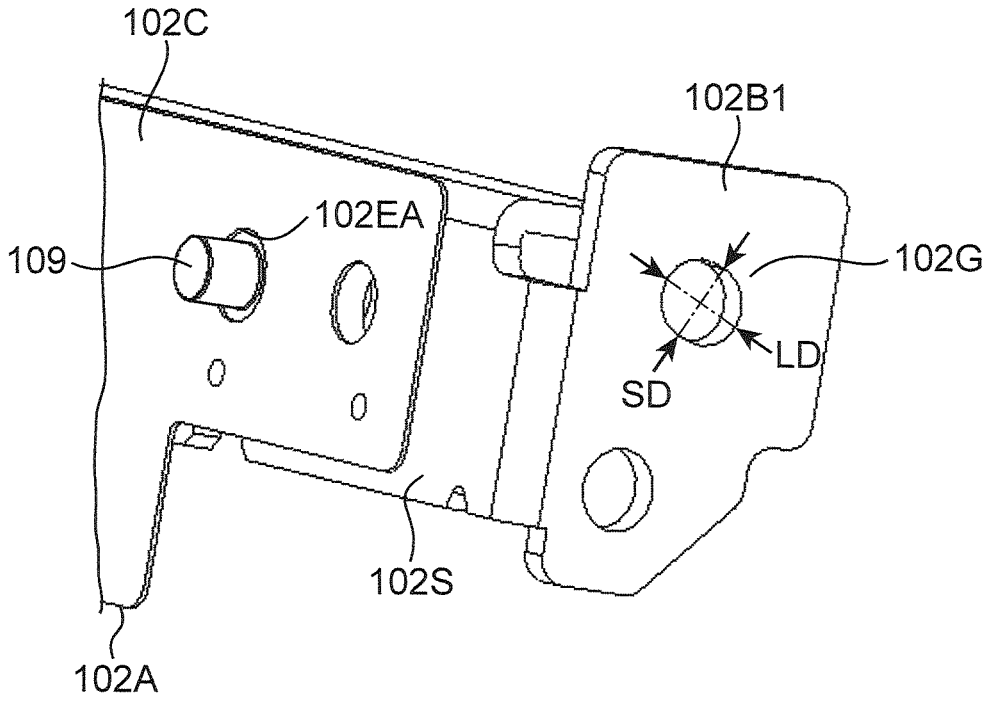
FIG. 8A is a perspective view of an end portion of the separating member on the side where a long hole is formed.
Figure 8B:
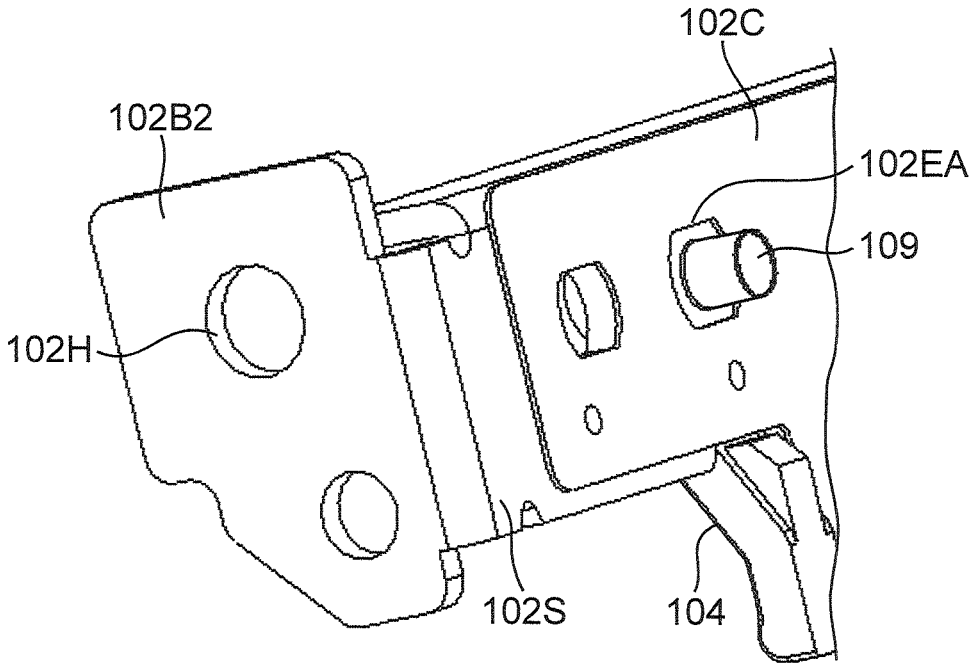
FIG. 8B is a perspective view of an end portion of the separating member on the side where a large-diameter hole is formed.
Figure 9:
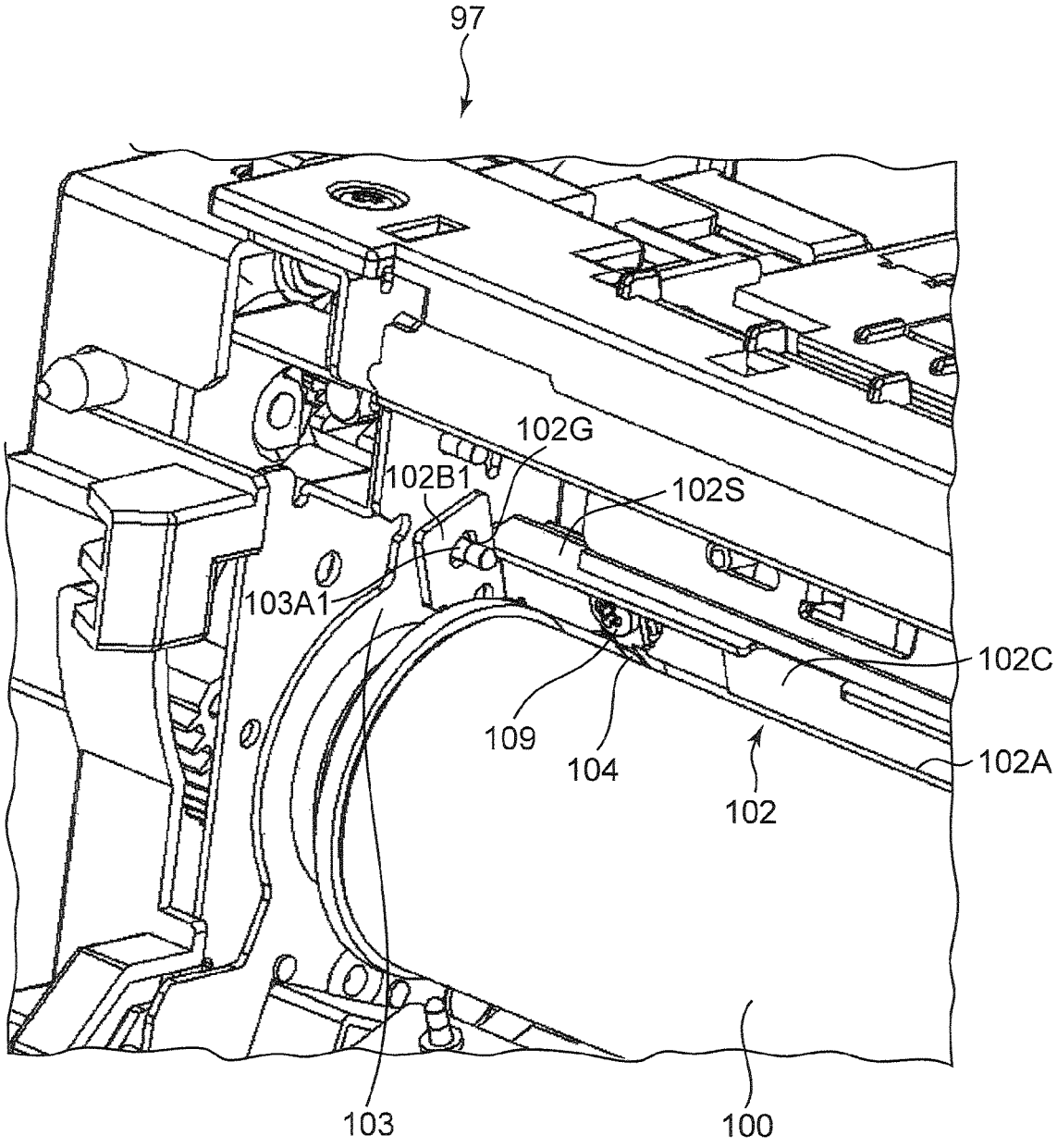
FIG. 9 is a perspective view for explaining an attachment form (on the long hole side) of the separating member.
Figure 10:
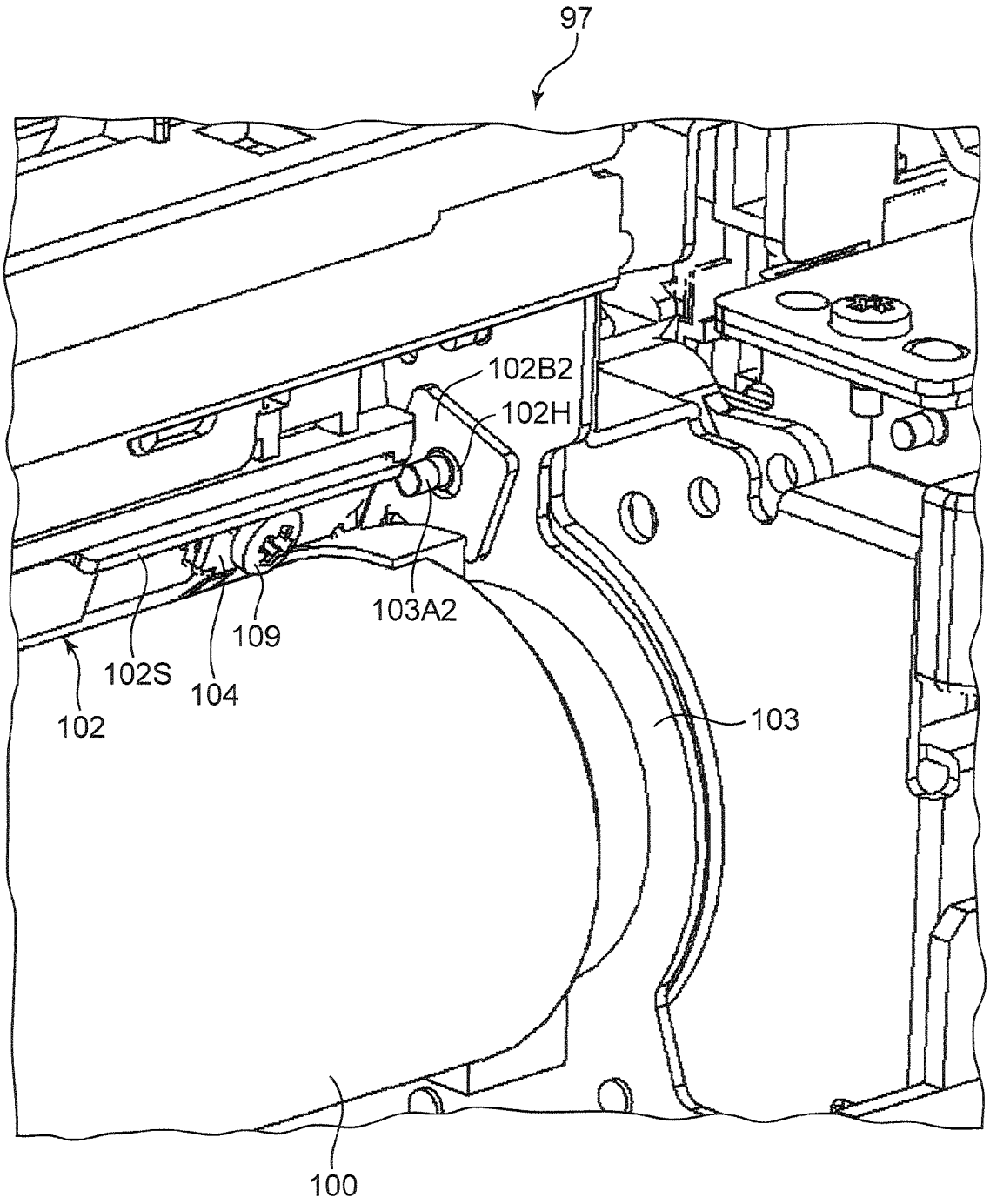
FIG. 10 is a perspective view for explaining an attachment form (on a large-diameter hole side) of the separating member.

FIG. 8A is a perspective view of an end portion of the first end plate 102B1 on a side where the long hole 102G is formed and FIG. 8B is a perspective view of an end portion of second end plate 102B2 on a side where the large-diameter hole 102H is formed. FIGS. 9 and 10 are perspective views for explaining an attachment form of the separating member 102. FIG. 9 shows the long hole 102G side and FIG. 10 shows the large-diameter hole 102H side.

As shown in FIG. 9, in the supporting member 103, a first fulcrum member 103A1 is vertically provided in the axial direction of the fixing roller 100 to correspond to the first end plate 102B1. The first fulcrum member 103A1 is a columnar member and is inserted into the long hole 102G provided in the first end plate 102B1. As shown in FIG. 10, in the supporting member 103, similarly, a second fulcrum member 103A2 is vertically provided to correspond to the second end plate 102B2. The second fulcrum member 103A2 is also a columnar member and is inserted into the large-diameter hole 102H provided in the second end plate 102B2.

In this way, the first and second fulcrum members 103A1 and 103A2 are respectively arranged to be opposed to both end positions of the main body section 102C and are respectively inserted into the long hole 102G and the large-diameter hole 102H to function as a fulcrum for pivotably supporting the separating member 102. That is, the separating member 102 can pivot around the axis of the first and second fulcrum members 103A1 and 103A2. As a result, the separating member 102 can change a posture between a first posture in which the distal end portion 102A of the separating member 102 comes close to the circumferential surface of the fixing roller 100 and a second posture in which the distal end portion 102A separates from the circumferential surface of the fixing roller 100. In this embodiment, a supporting mechanism for pivotably supporting the separating member 102 is configured by the first and second end plates 102B1 and 102B2 and the first and second fulcrum members 103A1 and 103A2.

Referring to FIG. 8A, the long hole 102G drilled in the first end plate 102B1 is a long hole including a short-diameter portion SD substantially equal to the diameter of the first fulcrum member 103A1 formed by a columnar body and a long-diameter portion LD longer (about 1.5 to 2 times longer) than the diameter of the first fulcrum member 103A1. The long-diameter portion LD extends in a predetermined direction in which the separating member 102 should be shifted (moved). In this relation between the long hole 102G and the first fulcrum member 103A1, the separating member 102 cannot move in the direction of the short-diameter portion SD and is allowed to substantially shift only in a predetermined direction in which the long-diameter portion LD extends.

Referring to FIG. 8B, a large-diameter hole 102H drilled in the second end plate 102B2 is a circular hole having an inner diameter larger (1.3 to 2 times larger) than the diameter of the second fulcrum member 103A2 formed by a columnar body. Therefore, in a state in which the second fulcrum member 103A2 is inserted into the large-diameter hole 102H, play based on the diameter difference is present. In this relation between the large diameter hole 102H and the second fulcrum member 103A2, the displacement of the separating member 102 is not substantially restricted. The separating member 102 can be displaced in all directions within the range of the play.

With the fixing unit 97 according to this embodiment, the contact members 104 attached at both ends of the separating member 102 come into contact with the circumferential surface of the fixing roller 100, whereby the gap G having the predetermined distance is formed between the distal end portion 102A of the main body section 102C and the circumferential surface of the fixing roller 100. The long hole 102G allows the separating member 102 to substantially shift only in the predetermined direction in which the long-diameter portion LD extends. The large-diameter hole 102H does not substantially restrict the displacement of the separating member 102. Therefore, the fulcrum of the separating member 102 is not fixed. The separating member 102 can shift within the shift allowing range of the long hole 102G. Therefore, even if deviation occurs in parallelism between the distal end portion 102A of the separating member 102 and the axis of the fixing roller 100, since the contact section 104C and the circumferential surface of the fixing roller 100 come into contact with each other, a fulcrum position of the separating member 102 shifts on the insides of the long hole 102G and the large-diameter hole 102H to correct the deviation. Therefore, it is possible to maintain the parallelism between the distal end portion 102A and the circumferential surface of the fixing roller 100 and appropriately secure the gap G.

In addition, the position of the separating member 102 with respect to the fixing roller 100 is determined by three points, i.e., contact positions of the two contact members 104 (the contact sections 104C), which are arranged at both ends of the separating member 102, with the fixing roller 100 and a receiving position of the first fulcrum member 103A1 by the long hole 102G. That is, the large-diameter hole 102H is a circular hole having a diameter larger than the second fulcrum member 103A2 and substantially does not restrict the displacement of the separating member 102. Therefore, the large-diameter hole 102H does not contribute to the positioning of the separating member 102.

If the large-diameter hole 102H is a circular hole having an inner diameter substantially the same as the outer diameter of the second fulcrum member 103A2 or if the large-diameter hole 102H is a long hole same as the long hole 102G, the position of the separating member 102 with respect to the fixing roller 100 is determined by three points, i.e., receiving positions at two points of the first and second fulcrum members 103A1 and 103A2 and a contact position of one contact member 104 out of the two contact members 104 with the fixing roller 100. In this case, a linear pressure in a portion where the one contact member 104 comes into contact with the fixing roller 100 increases and could damage the fixing roller 100. Further, since it could occur that the other contact member 104 of the two contact members 104 does not come into contact with the fixing roller 100, appropriate securing of the gap G could be hindered. On the other hand, in this embodiment, both two contact members 104 contribute to the positioning of the separating member 102. Therefore, it is possible to reduce linear pressure in portions where the contact members 104 are in contact with the fixing roller 100 and stably maintain the gap G.

Figure 12:
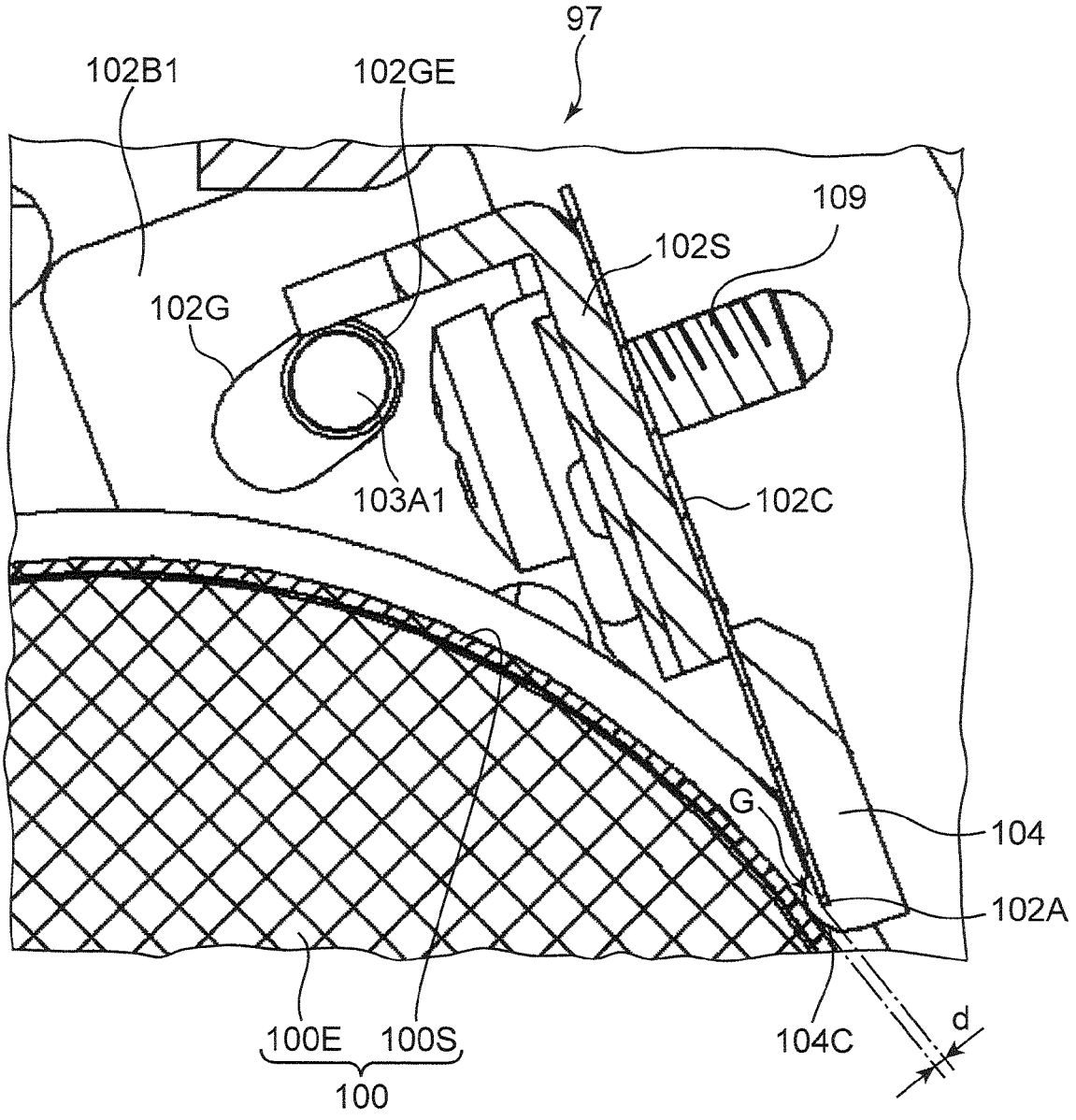
FIG. 12 is an enlarged sectional view showing the separating member (on the long hole side) in a first posture.
Figure 13:
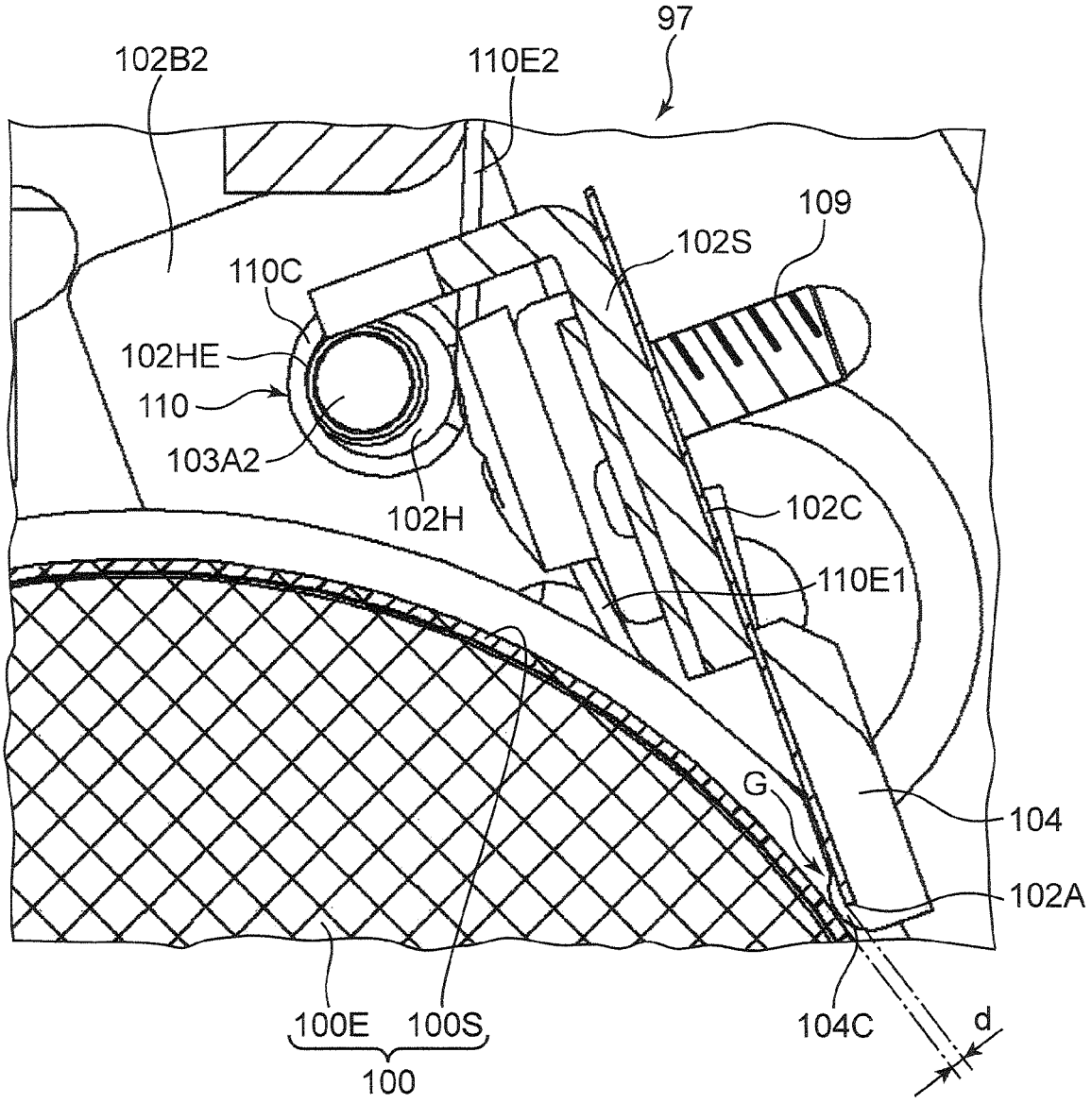
FIG. 13 is an enlarged sectional view showing the separating member (on the large-diameter hole side) in the first posture.

FIG. 11 is a main part sectional view (on the long hole 102G side) of the fixing unit 97 showing a state in which the distal end (the contact section 104C) of the contact member 104 is separated from the circumferential surface of the fixing roller 100 (a state in which the separating member 102 is in the second posture). FIG. 12 is an enlarged sectional view of FIG. 11 showing a state in which the contact section 104C is in contact with the circumferential surface of the fixing roller 100 (the first posture). FIG. 13 is a main part sectional view (the large-diameter hole 102H side) of the fixing unit 97 showing a state in which the separating member 102 is in the first posture.

In FIG. 11, the fixing roller 100 rotates in the counterclockwise direction and the pressurizing roller 101 rotates in the clockwise direction. Whereas most of the fixing roller 100 is a roller configured by the elastic base material 100E, the pressurizing roller 101 is a roller having rigidity. Therefore, in the fixing nip portion N, the circumferential surface of the pressurizing roller 101 pushes in the circumferential surface of the fixing roller 100. The separating member 102 is arranged further on the rotating direction downstream side of the fixing roller 100 than the fixing nip portion N.

In the second posture shown in FIG. 11, the contact section 104C of the contact member 104 is not in contact with the circumferential surface of the fixing roller 100. However, in the first posture shown in FIGS. 12 and 13, the contact section 104C is in contact with the circumferential surface of the fixing roller 100. In a state in which the contact member 104 is in contact with the circumferential surface of the fixing roller 100, the gap G having a distance d is formed between the distal end portion 102A of the separating member 102 and the circumferential surface of the fixing roller 100.

In FIG. 12, the first fulcrum member 103A1 is in contact with an end edge 102GE of the long hole 102G on a side separating from the fixing roller 100. In FIG. 13, the second fulcrum member 103A2 is in contact with a circumferential edge 102HE of the large-diameter hole 102H. Such contacts are realized by an urging spring 110 (an urging member) configured to urge the contact member 104, which is attached to the separating member 102, toward the circumferential surface of the fixing roller 100.

Figure 14:
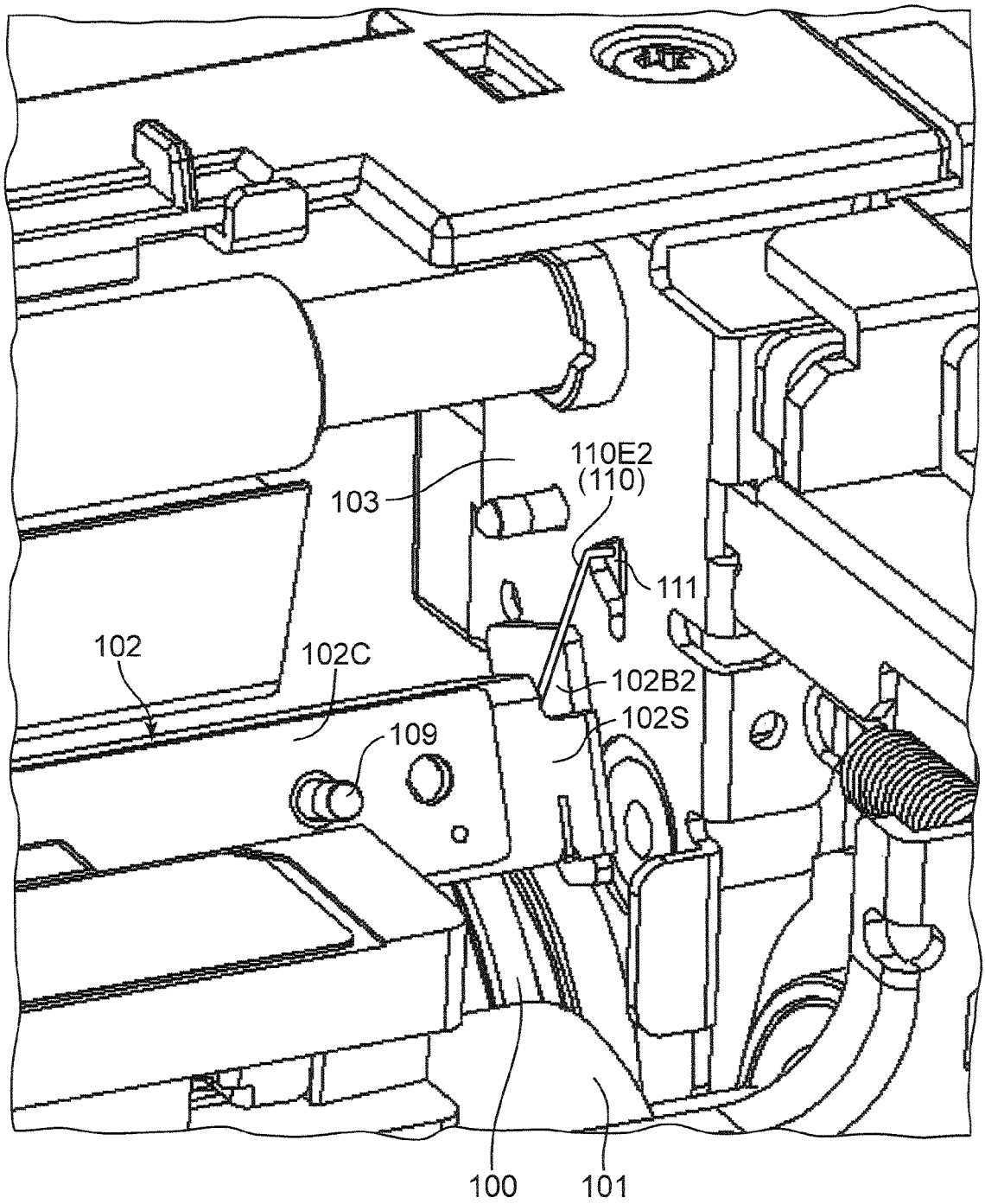
FIG. 14 is a perspective view for explaining an urging state of the separating member.

FIG. 14 is a perspective view for explaining an attachment form of the urging spring 110. Referring to FIGS. 13 and 14, the urging spring 110 is a helical torsion coil spring including a cylindrical coil section 110C, a bar-like first locking section 110E1 extended from one end side of the coil section 110C, and a bar-like second locking section 110E2 extended from the other end side.

The coil section 110C of the urging spring 110 is inserted through the second fulcrum member 103A2. The inner diameter of the coil section 110C is substantially the same as the inner diameter of the large-diameter hole 102H. The first locking section 110E1 is locked to a receiving section (not shown in the figure) provided in the holding sheet metal 102S of the separating member 102. The second locking section 110E2 is extended to the outside from the separating member 102 and locked to a locking hole 111 provided in the supporting member 103. The second locking section 110E2 is in contact with the locking hole 111 with an urging force. Consequently, an urging force is applied to the separating member 102 such that the distal end portion 102A of the main body section 102C thereof pivots around the axis of the first and second fulcrum members 103A1 and 103A2 in a direction toward the circumferential surface of the fixing roller 100.

The contact member 104 attached to the separating member 102 is brought into press-contact with the circumferential surface of the fixing roller 100 by the urging force. The contact member 104 is surely set in contact with the circumferential surface of the fixing roller 100. In addition, at least the first fulcrum member 103A1 is in contact the circumferential edge of the long hole 102G with the urging force. Therefore, the separating member 102 is positioned by locking at three points of the two contact member 104 and the first fulcrum member 103A1. In this way, the contact member 104 can be surely brought into contact with the circumferential surface of the fixing roller 100 by the urging spring 110. Therefore, the gap G having a predetermined distance is surely and stably formed between the separating member 102 and the fixing roller 100. The contact member 104 comes into contact with the non-passing regions 100B where a sheet does not pass on the circumferential surface of the fixing roller 100. Therefore, traces of damage are not left on toner images on the sheet.

Subsequently, a more preferable attachment form of the contact member 104 to the separating member 102 is illustrated. In the example explained in the embodiment, the contact member 104 is fixedly attached to the holding sheet metal 102S of the separating member 102 by the attachment screw 109. Instead, the contact member 104 can be attached to the separating member 102 in a state that the contact member 104 can be shifted in the radial direction of the fixing roller 100.

Figure 15:
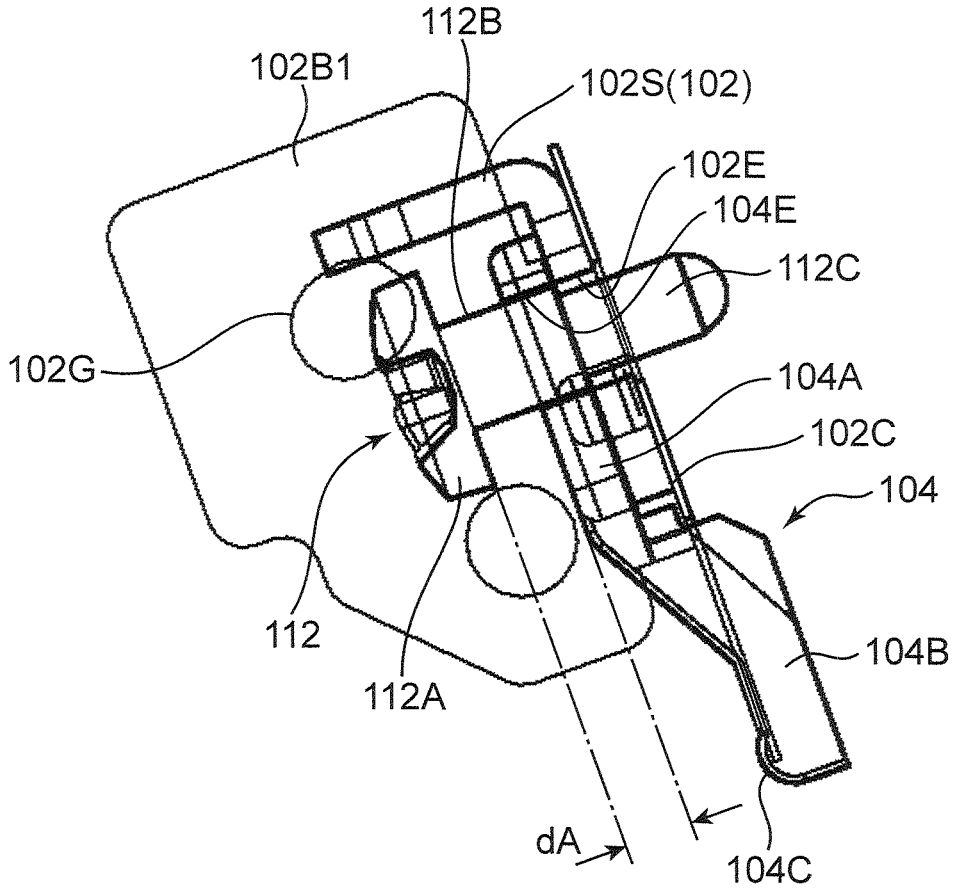
FIG. 15 is a sectional view showing another embodiment of an attachment form of the contact member to the separating member.

FIG. 15 is a sectional view showing a modified embodiment of an attachment form of the contact member 104 to the separating member 102. An end portion on the first end plate 102B1 where the long hole 102G is drilled is shown. In this modified embodiment, a SEMS screw 112 (an attachment member) is used instead of the attachment screw 109. The SEMS screw 112 includes a screw head 112A, a cylindrical section 112B provided continuously to the screw head 112A, and a tap section 112C provided continuously to the distal end side of the cylindrical section 112B. The cylindrical section 112B is a flat cylindrical portion without thread ridges. The tap section 112C is a portion with thread ridges.

The SEMS screw 112 is screwed in the screw hole 102E of the holding sheet metal 102S through the screw hole 104E provided in the attaching section 104A of the contact member 104. More specifically, while the tap section 112C is screwed in the screw hole 102E, the circumferential wall of the screw hole 104E and the circumferential surface of the cylindrical section 112B are not restricted. The length of the cylindrical section 112B is sufficiently larger than the thickness of the attaching section 104A. Therefore, the contact member 104 can shift between the rear surface of the screw head 112A and the starting end of the tap section 112C along the circumferential surface of the cylindrical section 112B. Consequently, the contact member 104 can shift in the radial direction of the fixing roller 100. Therefore, even if outer diameter fluctuation occurs in the fixing roller 100 or unevenness occurs on the circumferential surface of the fixing roller 100, it is possible to displace the contact member 104 following the outer diameter fluctuation or the unevenness and stably bring the contact section 104C into contact with the circumferential surface of the fixing roller 100. Therefore, it is possible to stably maintain the gap G.

This modified embodiment is particularly useful when the fixing unit includes the configuration shown in FIG. 11. As explained above, the fixing roller 100 includes the elastic base material 100E (a roller member) having elasticity and the fixing belt 100S fit on the elastic base material 100E. The contact section 104C of the contact member 104 is in contact with the circumferential surface of the fixing belt 100S. When the fixing roller 100 has the structure in which the fixing belt 100S is overlaid in the circumference of one roller member in this way, arbitrary tension cannot be applied to the fixing belt 100S. Therefore, the roller outer diameter of the fixing roller 100 tends to fluctuate because of thermal expansion or the like of the elastic base material 100E. Further, flapping of the fixing belt 100S sometimes occurs. Therefore, in the fixing roller 100, an advantage of using the attachment structure for the contact member 104 by the SEMS screw 112 is large.

As explained above, with the fixing unit 97 according to this embodiment, it is possible to appropriately secure, with the contact member 104, the gap G between the distal end portion 102A of the separating member 102 and the circumferential surface of the fixing roller 100. Further, it is possible to suppress a pressure applied to the circumferential surface of the fixing roller 100 by the contact member 104 and stably maintain the gap G. Therefore, it is possible to surely prevent winding of a sheet around the fixing roller 100.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A fixing device comprising:

first and second rollers configured to form a fixing nip portion;

a separating member for a sheet, arranged further toward a rotating direction downstream side of the first roller than the fixing nip portion and including a tabular member extending in an axial direction of the first roller;

a supporting mechanism configured to pivotably support the separating member to change a posture between a first posture in which a distal end of the tabular member comes close to a circumferential surface of the first roller and a second posture in which the distal end separates from the circumferential surface of the first roller;

contact members attached to the separating member at both end positions of the tabular member respectively and configured to, in the first posture, come into contact with the circumferential surface near both ends of the first roller and form a gap having a predetermined distance between the distal end of the tabular member and the circumferential surface of the first roller; and an urging member configured to urge the contact members toward the circumferential surface near of the first roller, wherein the supporting mechanism includes:

first and second fulcrum members configured as columnar members, and respectively arranged to be opposed to the both end positions of the tabular member and functioning as a fulcrum for pivoting of the separating member; and first and second holes provided in the separating member, the first fulcrum member being inserted into the first hole and the second fulcrum member being inserted into the second hole, the first hole is a hole that allows the separating member to shift only in a predetermined direction, the first hole being a long hole including a short-diameter portion having a diameter equal to a diameter of the first fulcrum member and a long-diameter portion having a diameter longer than the diameter of the first fulcrum member, the long-diameter portion extending in the predetermined direction, the second hole is a large-diameter hole having a diameter 1.3 to 2 times larger than a diameter of the second fulcrum member so that play is present between the second fulcrum member and the second hole that permits the second fulcrum member to be displaced in all directions within a range defined by the play, and the urging member has an urging force in the first posture so that the contact members are in contact with the circumferential surface of the first roller, the first fulcrum member is in contact with a part of an edge of the long hole and the second fulcrum member is in contact with a part of an edge of the large-diameter hole.

2. The fixing device according to claim 1, wherein the separating member includes:

a thin flat main body section extending in the axial direction of the first roller and functioning as the tabular member;

a holding plate configured to hold the main body section; and a pair of end plates provided at both ends of the holding plate, and the first hole and the second hole are respectively provided in the pair of end plates.

3. The fixing device according to claim 1, wherein both ends of the first roller, with which the contact members come into contact, are non-passing regions with which a sheet passing through the fixing nip portion does not come into contact.

4. The fixing device according to claim 1, further comprising an attaching member configured to attach the contact members to the separating member, wherein the attaching member attaches the contact members to the separating member in a state that the contact members can shift in a radial direction of the first roller.

5. The fixing device according to claim 4, wherein the first roller includes a roller member having elasticity and a fixing belt overlaid on the roller member, and the contact members come into contact with a circumferential surface of the fixing belt.

6. The fixing device according to claim 1, wherein both ends of the first roller, with which the contact members come into contact, are non-passing regions with which a sheet passing through the fixing nip portion does not come into contact, and the urging member configured to urge the contact members toward the circumferential surface in the non-passing regions of the first roller.

7. An image forming apparatus comprising:

an image forming section configured to transfer a toner image onto a sheet; and a fixing device configured to fix the toner image on the sheet, wherein the fixing device includes:

first and second rollers configured to form a fixing nip portion;

a separating member for a sheet, arranged further toward a rotating direction downstream side of the first roller than the fixing nip portion and including a tabular member extending in an axial direction of the first roller;

a supporting mechanism configured to pivotably support the separating member to change a posture between a first posture in which a distal end of the tabular member comes close to a circumferential surface of the first roller and a second posture in which the distal end separates from the circumferential surface of the first roller;

contact members attached to the separating member at both end positions of the tabular member respectively and configured to, in the first posture, come into contact with the circumferential surface near both ends of the first roller and form a gap having a predetermined distance between the distal end of the tabular member and the circumferential surface of the first roller; and an urging member configured to urge the contact members toward the circumferential surface near of the first roller, wherein the supporting mechanism includes:

first and second fulcrum members configured as columnar members, and respectively arranged to be opposed to the both end positions of the tabular member and functioning as a fulcrum for pivoting of the separating member; and first and second holes provided in the separating member, the first fulcrum member being inserted into the first hole and the second fulcrum member being inserted into the second hole, the first hole is a hole that allows the separating member to shift only in a predetermined direction, the first hole being a long hole including a short-diameter portion having a diameter equal to a diameter of the first fulcrum member and a long-diameter portion having a diameter longer than the diameter of the first fulcrum member, the long-diameter portion extending in the predetermined direction the second hole is a large-diameter hole having a diameter 1.3 to 2 times larger than a diameter of the second fulcrum member so that play is present between the second fulcrum member and the second hole that permits the second fulcrum member to be displaced in all directions within a range defined by the play, and the urging member has an urging force in the first posture so that the contact members are in contact with the circumferential surface of the first roller, the first fulcrum member is in contact with a part of an edge of the long hole and the second fulcrum member is in contact with a part of an edge of the large-diameter hole.

8. The image forming apparatus according to claim 7, wherein the separating member includes:

a thin flat main body section extending in the axial direction of the first roller and functioning as the tabular member;

a holding plate configured to hold the main body section; and a pair of end plates provided at both ends of the holding plate, and the first hole and the second hole are respectively provided in the pair of end plates.

9. The image forming apparatus according to claim 7, wherein both ends of the first roller, with which the contact members come into contact, are non-passing regions with which a sheet passing through the fixing nip portion does not come into contact.

10. The image forming apparatus according to claim 7, wherein the fixing device further includes an attaching member configured to attach the contact members to the separating member, and the attaching member attaches the contact members to the separating member in a state that the contact members can shift in a radial direction of the first roller.

11. The image forming apparatus according to claim 10, wherein the first roller includes a roller member having elasticity and a fixing belt overlaid on the roller member, and the contact members come into contact with a circumferential surface of the fixing belt.

12. The image forming apparatus according to claim 7, wherein both ends of the first roller, with which the contact members come into contact, are non-passing regions with which a sheet passing through the fixing nip portion does not come into contact, wherein the fixing device further includes an urging member configured to urge the contact members toward the circumferential surface in the non-passing regions of the first roller.

* * * * *